US010422330B2

(12) United States Patent
Tamura et al.

(10) Patent No.: US 10,422,330 B2
(45) Date of Patent: Sep. 24, 2019

(54) HIGH PRESSURE FUEL PUMP

(75) Inventors: Shingo Tamura, Hitachinaka (JP); Atsuji Saito, Hitachinaka (JP); Satoshi Usui, Hitachinaka (JP); Masahiko Hayatani, Hitachinaka (JP)

(73) Assignee: HITACHI AUTOMOTIVE SYSTEMS, LTD., Hitachinaka-Shi (JP)

( * ) Notice: Subject to any disclaimer, the term of this patent is extended or adjusted under 35 U.S.C. 154(b) by 464 days.

(21) Appl. No.: 14/360,778

(22) PCT Filed: Nov. 30, 2011

(86) PCT No.: PCT/JP2011/006673

§ 371 (c)(1),
(2), (4) Date: May 27, 2014

(87) PCT Pub. No.: WO2013/080253

PCT Pub. Date: Jun. 6, 2013

(65) Prior Publication Data

US 2014/0314601 A1 Oct. 23, 2014

(51) Int. Cl.
*F04B 39/00* (2006.01)
*F04B 1/04* (2006.01)
(Continued)

(52) U.S. Cl.
CPC ..... *F04B 39/0005* (2013.01); *F02M 59/367* (2013.01); *F02M 59/44* (2013.01);
(Continued)

(58) Field of Classification Search
CPC .... F04B 39/0005; F04B 53/16; F04B 1/0404; F04B 53/162; F04B 53/166; F04B 53/168;
(Continued)

(56) References Cited

U.S. PATENT DOCUMENTS 4,573,886 A * 3/1986 Maasberg ..... F04B 53/10 417/454
6,193,481 B1 * 2/2001 Alaze ..... B60T 8/4031 417/549
(Continued)

FOREIGN PATENT DOCUMENTS

JP 08-093509 A 4/1996
JP 2001-207852 A 8/2001
(Continued)

OTHER PUBLICATIONS

PCT International Search Report on application PCT/JP2011/006673 dated Jan. 17, 2012; 3 pages.

*Primary Examiner* — Philip E Stimpert
(74) *Attorney, Agent, or Firm* — Foley & Lardner LLP

(57) ABSTRACT

High pressure fuel pump includes a cylinder which is fitted in a concave portion formed in a pump housing and which defines a compression chamber of the pump and a plunger which pressurizes, by sliding against the cylinder, the fluid in the compression chamber. It is structured such that the fluid sucked into the compression chamber by reciprocating motion of the plunger is pressurized and is then discharged from the compression chamber. The cylinder is formed of a cylindrical member which has a ceiling portion and in which the compression chamber is partitionedly formed. A fuel suction path formed in the pump housing reaches the compression chamber through the cylinder and a fuel discharge path formed in the pump housing is connected to the compression chamber through the cylinder. The cylinder is pressed against the pump body by a fuel pressurizing force applied to the cylinder.

14 Claims, 14 Drawing Sheets

(51) Int. Cl.

| | |
|---|---|
| ***F04B 53/16*** | (2006.01) |
| ***F02M 59/44*** | (2006.01) |
| ***F02M 63/00*** | (2006.01) |
| ***F02M 59/36*** | (2006.01) |

(52) U.S. Cl.
CPC ..... *F02M 63/0019* (2013.01); *F04B 1/0404* (2013.01); *F04B 53/16* (2013.01)

(58) Field of Classification Search
CPC ... F02M 59/44; F02M 59/367; F02M 63/0019
USPC ..... 417/568; 29/888.06
See application file for complete search history.

(56) References Cited

U.S. PATENT DOCUMENTS

| | | | | |
|---|---|---|---|---|
| 6,474,127 | B1 * | 11/2002 | Bonde | B21K 1/14<br>29/888.06 |
| 6,631,706 | B1 * | 10/2003 | Yamada | F02M 59/442<br>123/447 |
| 2004/0052652 | A1 * | 3/2004 | Yamada | F02M 59/102<br>417/273 |
| 2004/0052664 | A1 | 3/2004 | Saito et al. | |

FOREIGN PATENT DOCUMENTS

| | | | |
|---|---|---|---|
| JP | 09-250427 | | 9/2007 |
| JP | 2007-231959 | A | 9/2007 |
| WO | WO 02/055870 | A1 | 7/2002 |

* cited by examiner

HIGH PRESSURE FUEL PUMP

TECHNICAL FIELD

The present invention relates to a high pressure fuel pump, particularly, to one having a cup-shaped cylinder.

BACKGROUND ART

In Japanese Unexamined Patent Application Publication No. 2007-231959, a high pressure fuel pump is disclosed in which a compression chamber is formed by press-fitting a cup (called a plug in Japanese Unexamined Patent Application Publication No. 2007-231959) and a cylinder to an inner cylindrical surface (inner periphery) portion of a concave portion formed in a pump housing. In the high pressure fuel pump, the cylinder including the cup is pressure-fixed to the inner periphery of the pump housing by the screw thrust force of a cylinder holder. It is also stated that the cup and the cylinder may be integrally structured.

CITATION LIST

Patent Literature

Patent Literature 1: Japanese Unexamined Patent Application Publication No. 2007-231959

SUMMARY OF INVENTION

Technical Problem

The cup and the cylinder that are fitted to the inner cylindrical surface (inner periphery) portion of the pump housing are subjected to thrust forces from other components, for example, the cylinder holder, so that they cannot be fixed unless they are held by pressing.

It, therefore, becomes necessary to dispose the cylinder holder in a lower portion of the pump housing. This results in increasing the number of components and the total size of the high pressure fuel pump.

The cylinder that is used as a part of the compression chamber is, when the fuel is compressed, subjected to a pressure in the direction for downwardly letting the cylinder come out of the pump housing. Therefore, it is necessary to increase the fixing force of the cylinder holder as the fuel discharge pressure increases. This causes concern that the cylinder holder may be made larger and more complicated.

An object of the present invention is to provide, to solve the above problem, a low-cost, compact, light, high-pressure, high-reliability fuel pump.

To be specific, a mechanism for simplifying the structure of a cylinder holder is provided.

A mechanism for preventing cylinder displacement caused by a fuel discharge pressure is also provided.

Solution to Problem

According to the high pressure fuel pump of the present invention, the above object is achieved by fitting a cup-shaped cylinder to an inner cylindrical surface (inner periphery) portion of a concave portion formed in a pump housing and forming a compression chamber by the inner cylindrical surface (inner periphery) portion and a ceiling portion of the cylinder.

Advantageous Effects of Invention

According to the high pressure fuel pump structured as described above of the present invention, even in cases where the fuel discharge pressure (pressure in the compression chamber) is set to a high pressure, the cylinder is pressed, by the pressure in the compression chamber, against the pump housing. This makes it possible to simplify a cylinder holder and realize a compact, light-weight, high pressure fuel pump.

DESCRIPTION OF EMBODIMENTS

Embodiments of the present invention will be described below based on drawings.

First Embodiment

An embodiment of the present invention will be described below with reference to FIGS. 1 to 11.

Figure 1:
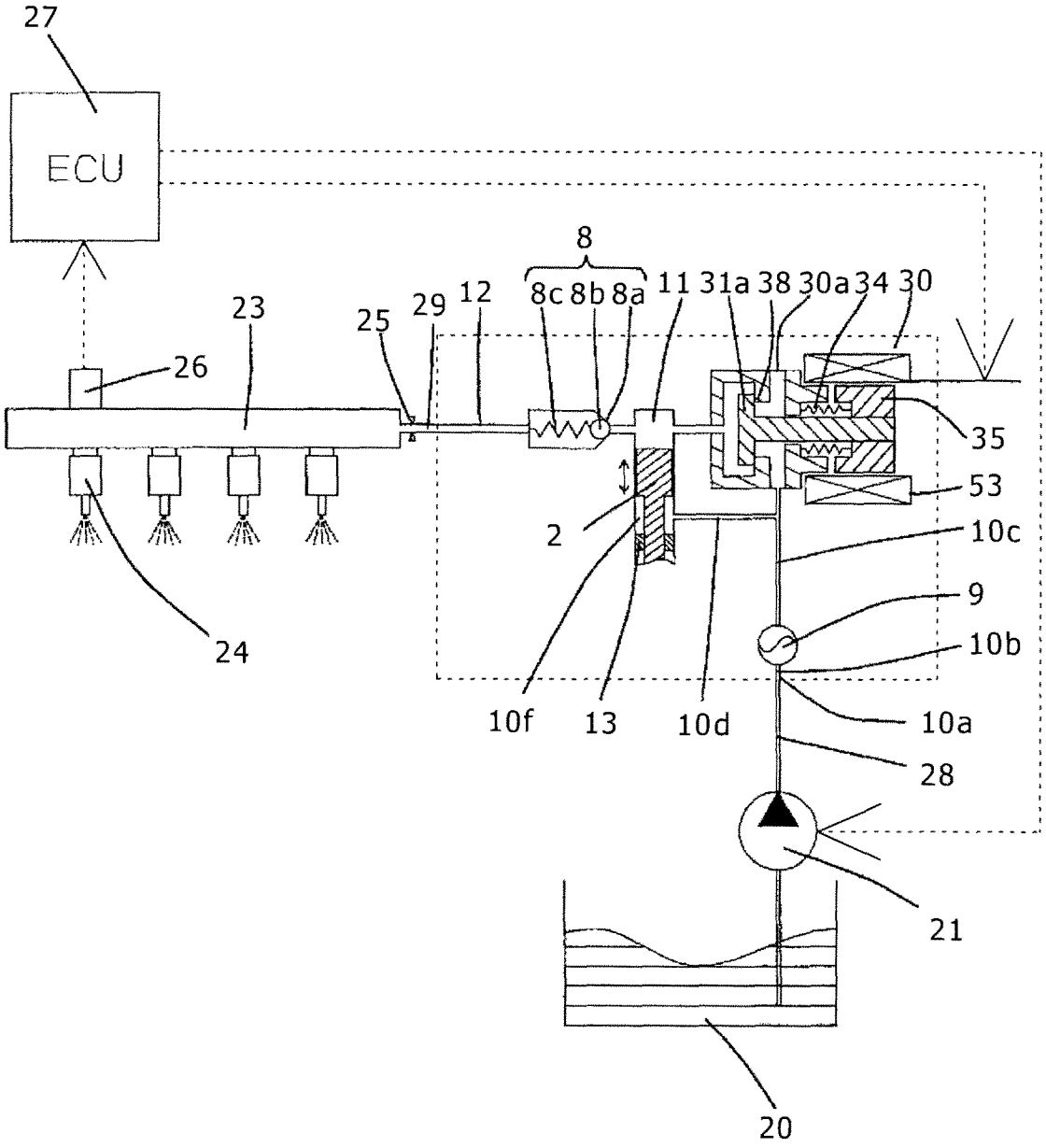
FIG. 1 shows an example of a fuel supply system using a high pressure fuel pump according to a first embodiment of the present invention.

In FIG. 1, the broken line box represents a pump housing 1 of a high pressure pump. Namely, the mechanisms and components shown inside the broken line box are integrally built into the pump housing 1 of the high pressure pump.

The fuel contained in a fuel tank 20 is, based on a signal from an engine control unit 27 (hereinafter referred to as an "ECU"), pumped up by a feed pump 21 and is, after being pressurized to an appropriate feed pressure, sent to a suction port 10*a* of the high pressure fuel pump through a suction pipe 28.

The fuel, after passing the suction port 10*a*, passes a filter 102 fixed in a suction joint 101 and reaches, via a suction flow path 10*b*, a metal diaphragm damper 9, and a low-pressure fuel chamber 10*c*, a suction port 30*a* of a solenoid valve mechanism 30 making up a volume variation mechanism.

The suction filter 102 included in the suction joint 101 plays a role of absorbing, by means of the fuel flow, foreign objects present between the fuel tank 20 and the suction port 10*a* into the high pressure fuel pump.

Figure 4:
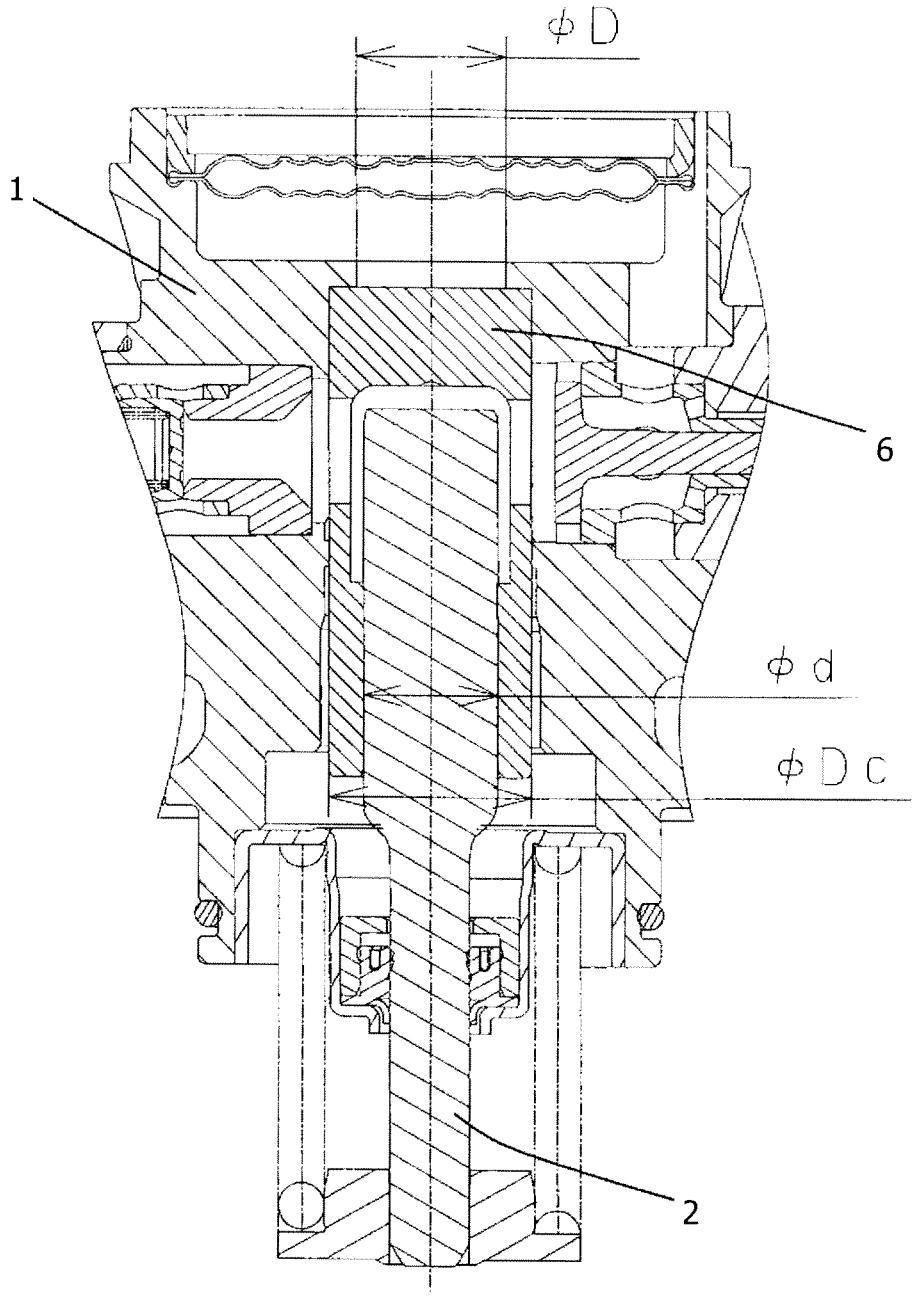
FIG. 4 shows dimensions of a plunger 2 and a cylinder of the high pressure fuel pump according to the first embodiment of the present invention.

FIG. 4 is an enlarged view of a solenoid suction valve mechanism 30 in a state with a solenoid coil 53 unenergized.

Figure 5:
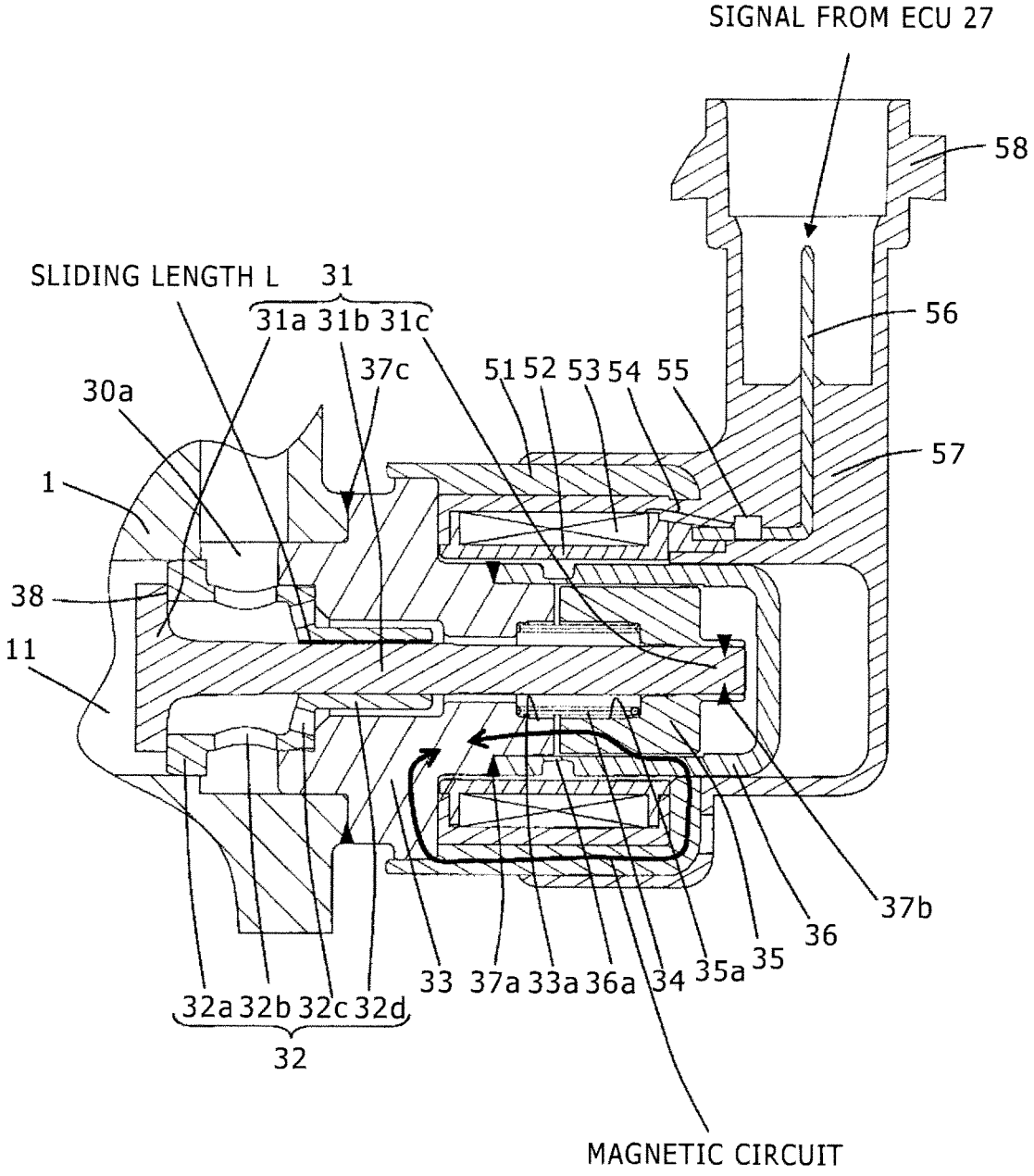
FIG. 5 is an enlarged view of a solenoid suction valve mechanism 30 in a state with a solenoid coil 52 unenergized of the high pressure fuel pump according to the first embodiment of the present invention.

FIG. 5 is an enlarged view of the solenoid suction valve mechanism 30 in a state with the solenoid coil 53 energized.

The pump housing 1 includes, in a central portion thereof, a concave portion 1A for accommodating a cylinder 6 which includes a compression chamber 11, and a hole 30A for fitting the solenoid suction valve mechanism 30 is formed to be communicated with the compression chamber 11.

A plunger rod 31 includes three portions, i.e. a suction valve portion 31*a*, a rod portion 31*b*, and an anchor fixing portion 31*c*. An anchor 35 is fixedly welded, at a welding portion 37*b*, to the anchor fixing portion 31*c*.

A spring 34 is fitted to an anchor inner periphery 35*a* and an inner periphery 33*a* of a first core portion, and its spring force is applied in the direction for separating the anchor 35 and the first core portion 33 from each other.

A valve seat 32 includes a suction valve seat portion 32*a*, a suction passage portion 32*b*, a press-fitting portion 32*c*, and a sliding portion 32*d*. The press-fitting portion 32*c* is fixedly press-fitted in the first core portion 33. The suction valve seat portion 32*a* is fixedly press-fitted in the pump housing 1 such that the compression chamber 11 and the suction port 30*a* are completely isolated from each other by the press-fitted portion.

The first core portion 33 is fixedly welded, at a welding portion 37*c*, to the pump housing 1, thereby isolating the suction port 30*a* from outside the high pressure fuel pump.

A second core portion 36 is fixed, at a welding portion 37*a*, to the first core portion 33, thereby completely isolating the interior space of the second core portion 36 from outside space. The second core portion 36 is provided with a magnetic orifice portion 36*a*.

In a state in which the solenoid coil 53 is not energized and there is no fluid differential pressure between a suction flow path 10*c* (suction port 30*a*) and the compression chamber 11, the plunger rod 31 is in a position reached by being moved rightward by the spring 34 as shown in FIG. 4. In this state, a suction port 38 is closed with the suction valve portion 31*a* and the suction valve seat portion 32*a* being in contact with each other.

Figure 2:
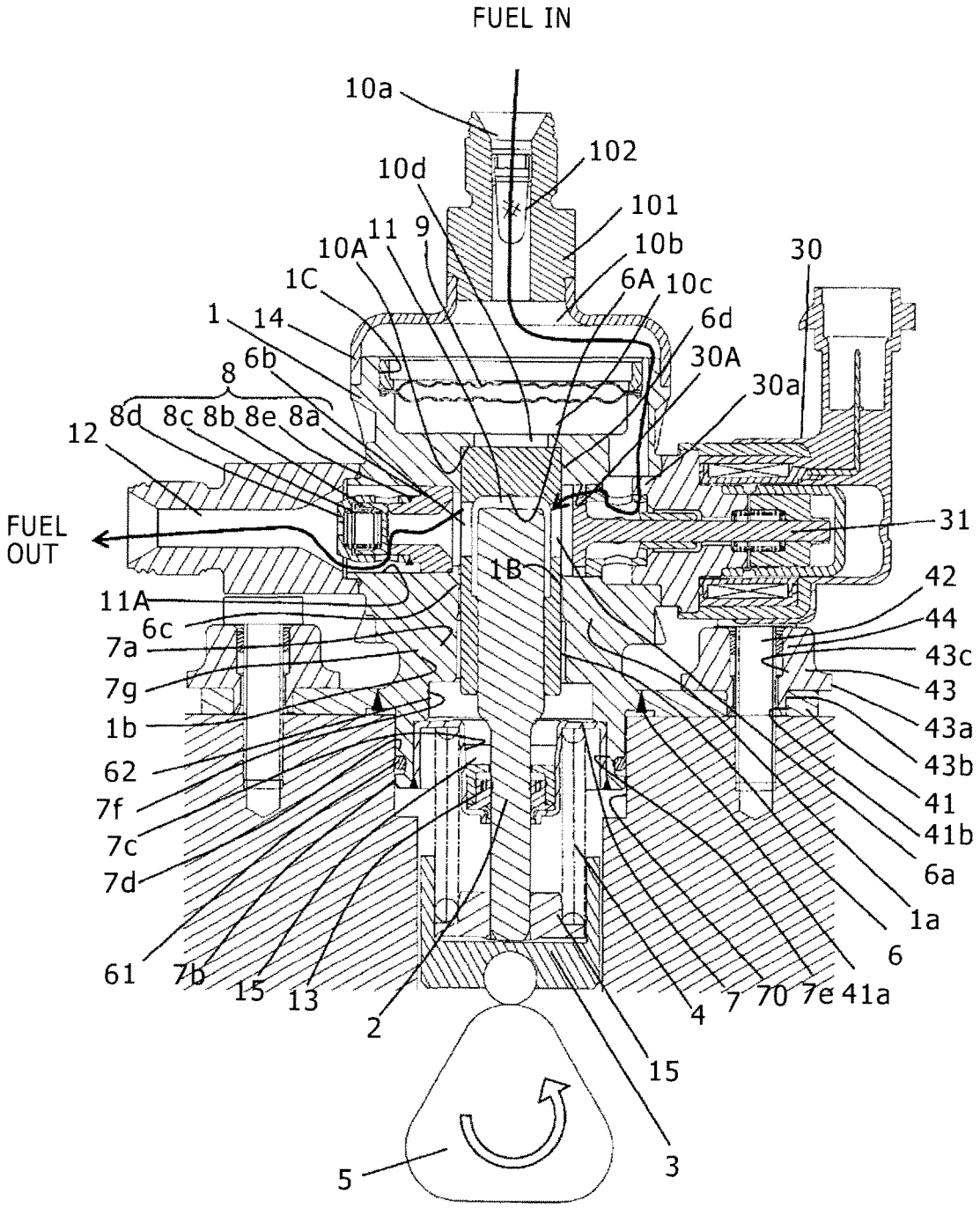
FIG. 2 is a vertical sectional view of the high pressure fuel pump according to the first embodiment of the present invention.
Figure 3:
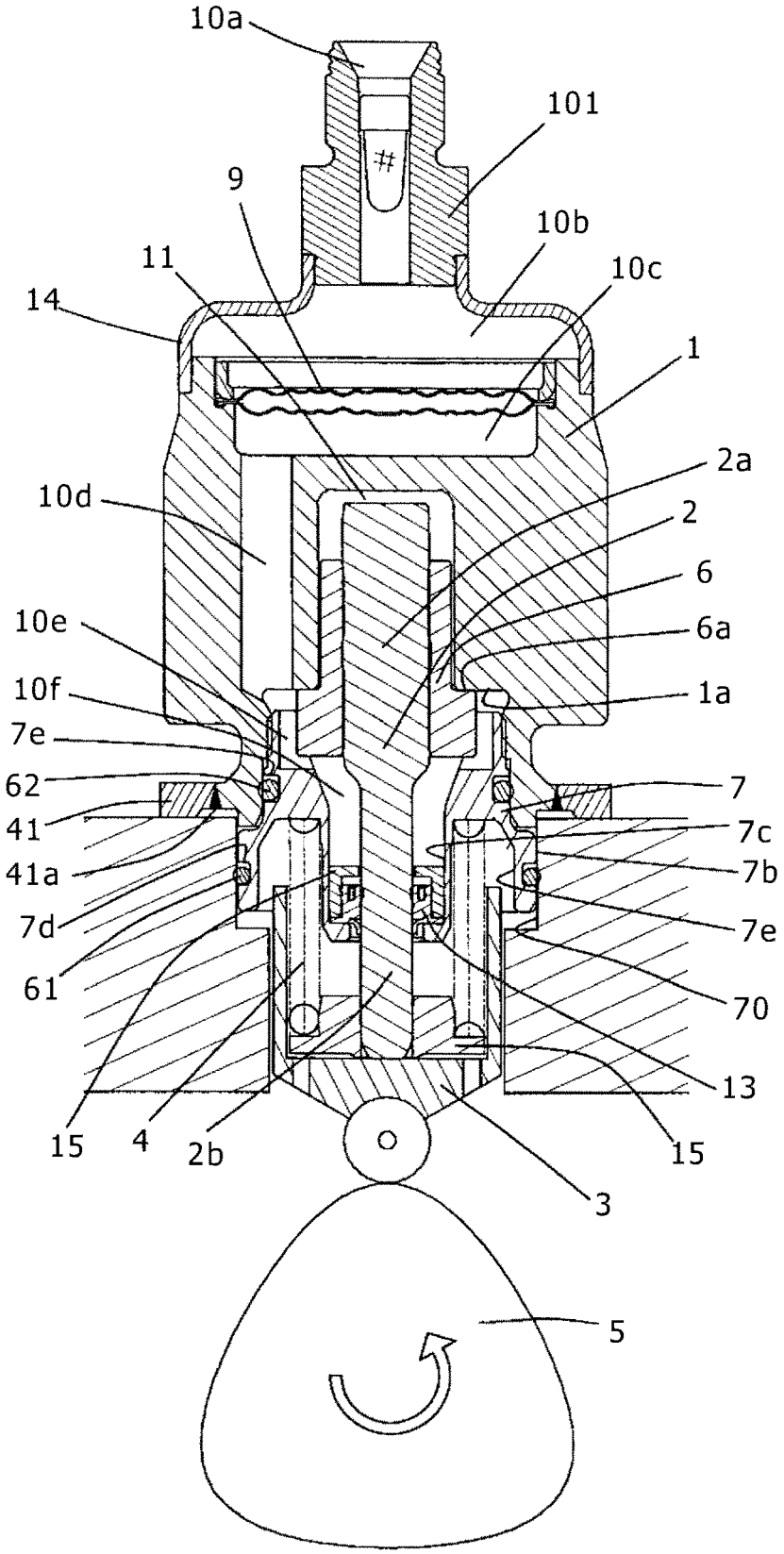
FIG. 3 is a vertical sectional view of the high pressure fuel pump according to the first embodiment of the present invention, taken in a direction perpendicularly shifted from FIG. 2.

When the pump is, as shown in FIG. 2, in a suction stroke in which a plunger 2 is downwardly displaced by the rotation of a cam 5 being described later, the volume of the compression chamber 11 increases causing the fuel pressure in the compression chamber 11 to decrease. If, in this stroke, the fuel pressure in the compression chamber 11 becomes lower than the pressure in the low-pressure fuel chamber 10*c* (suction port 30*a*), the fluid differential pressure causes a valve opening force (force in the direction for displacing the suction valve portion 31*a* leftward as seen in FIG. 1) to be applied to the suction valve portion 31*a*.

The suction valve portion 31*a* is set to overcome, when provided with the valve opening force by the fluid differential pressure, the bias force of the spring 34 to open a suction port 38. When the fluid differential pressure is large, the suction valve portion 31*a* completely opens bringing the anchor 31 into contact with the first core portion 33. When the fluid differential pressure is small, the suction valve portion 31*a* does not completely open and the anchor 31 does not come into contact with the first core portion 33.

When, in this state, a control signal from the ECU 27 is applied to the solenoid suction valve mechanism 30, an electric current flows through the solenoid coil 53 of the solenoid suction valve mechanism 30, generating a magnetic bias force between the first core portion 33 and the anchor 31 biasing them to attract each other. As a result, a magnetic bias force for moving the plunger rod 31 leftward as seen in the figure is exerted to the plunger rod 31.

When the suction valve portion 31*a* is completely open, the open state is maintained. When the suction valve portion 31*a* is not completely open, the magnetic bias force promotes opening of the suction valve portion 31*a* allowing the suction valve portion 31*a* to open completely. This brings the anchor 31 into contact with the first core portion 33, then their state of being in contact with each other is maintained.

As a result, the state in which the suction port 38 has been opened by the suction valve portion 31*a* is maintained and the fuel coming through the suction port 30*a* flows into the compression chamber 11 via the suction passage portion 32*b* and the suction port 38.

When, with an input voltage applied to the solenoid suction valve mechanism 30, the plunger 2 finishes the suction stroke and proceeds to a compression stroke in which the plunger 2 is displaced upward as seen in FIG. 2, the suction valve portion 31*a* is still left open with the magnetic bias force retained.

As the compression motion of the plunger 2 progresses, the volume of the compression chamber 11 decreases. In this state, the fuel once sucked into the compression chamber 11 is returned to the suction flow path 10*c* (suction port 30*a*) through the suction port 38 in an open state, so that the pressure in the compression chamber does not rise. This phase is referred to as a return phase.

Cancelling, in this state, the control signal from the ECU 27 and, thereby, deenergizing the solenoid coil 53 causes, after a certain amount of time (after a magnetically or mechanically caused time lag), the magnetic bias force that has been applied to the plunger rod 31 to disappear. When the electromagnetic force applied to the plunger rod 31 disappears, the suction valve portion 31*a* subjected to the bias force of the spring 34 closes the suction port 38. As soon as the suction port 38 closes, the fuel pressure in the compression chamber 11 starts rising with the upward movement of the plunger 2. When the fuel pressure in the compression chamber 11 exceeds the pressure at a fuel discharge port 12, the fuel remaining in the compression chamber 11 is discharged at high pressure via a discharge valve unit 8 to be fed to a common rail 23. This phase is referred to as a discharge phase. Namely, the compression stroke (an ascending stroke from a bottom dead point to a top dead point) of the plunger 2 includes a return phase and a discharge phase.

The amount of high-pressure fuel to be discharged can be controlled by controlling the timing of discontinuing the energization of the solenoid coil 53 of the solenoid suction valve mechanism 30.

When the timing of discontinuing the energization of the solenoid coil 53 is advanced, in a compression stroke, the proportion of the return phase decreases and the proportion of the discharge phase increases.

Namely, the amount of fuel returned to the suction flow path 10*c* (suction port 30*a*) decreases and the amount of fuel discharged at high pressure increases.

When, on the other hand, the timing of discontinuing the energization of the solenoid coil 53 is delayed, in a compression stroke, the proportion of the return phase increases and the proportion of the discharge phase decreases. Namely, the amount of fuel returned to the suction flow path 10*c* increases and the amount of fuel discharged at high pressure decreases. The timing of discontinuing the energization of the solenoid coil 53 is controlled by a command from the ECU.

Thus, in the above-described structure, by controlling the timing of discontinuing the energization of the solenoid coil 53, the amount of fuel discharged at high pressure can be adjusted to an amount required by an internal combustion engine.

Thus, of the fuel led to the fuel suction port 10*a*, a required amount is, in the compression chamber 11, pressurized to a high pressure by a reciprocating motion of the plunger 2 and is pressure-fed from the fuel discharge port 12 to the common rail 23.

The common rail 23 is mounted with injectors 24 and a pressure sensor 26. The number of the injectors 24 equals the number of cylinders included in the internal combustion engine. Each of the injectors 24 injects fuel into the corresponding cylinder by opening/closing its valve according to control signals from the engine control unit (ECU) 27.

At this time, as the plunger 2 reciprocally moves up and down, the suction valve portion 31*a* repeats opening and closing the suction port 38 and the plunger rod 31 reciprocally moves left and right as seen in the figure. At this time, the sliding portion 32*d* of the valve seat 32 restricts the motion of the plunger rod 31 so that the plunger rod 31 is movable only sidewardly as seen in the figure. Thus, sliding motion is repeated between the sliding portion 32*d* and the rod portion 31*b*. Therefore, the surface roughness of the sliding portion is required to be low enough not to generate resistance when the plunger rod 31 engages in sliding motion. A sliding portion clearance is to be determined as follows.

When the clearance is too large, the plunger rod 31 swings like a pendulum about the sliding portion thereof to cause the anchor 35 and the second core portion 36 to come into contact with each other. In this state, the sliding motion of the plunger rod 31 causes sliding between the anchor 35 and the second core portion 36. This increases the resistance against the sliding motion of the plunger rod 31 to impair the responsiveness of opening/closing motion of the suction port 38. Also, the anchor 35 and the second core portion 36 are each made of magnetic ferritic stainless steel and sliding motion between them may produce abrasion powder. Furthermore, as being described later, when the clearance between the anchor 35 and the second core portion 36 is smaller, the magnetic bias force is larger. When the clearance is too large, the magnetic bias force is inadequate to appropriately control the amount of fuel discharged at high pressure. Hence, the anchor 35 and the second core portion 36 are required to have as small a clearance as possible between them without contacting each other.

Hence, there is only one sliding area and the sliding portion 32*d* has an adequate sliding length L as shown in the figure. The sliding area is defined by the inner diameter of the sliding portion 32*d* and the outer diameter of the rod portion 31*b* both invariably having respective tolerances for manufacture. Also, there is invariably a tolerance for a sliding area clearance to be formed. On the other hand, there is an upper limit value for the clearance between the anchor 35 and the second core portion 36 related with the magnetic bias force mentioned above. Making the sliding length L large and, thereby, making the swinging of the plunger rod 31 small makes it possible to absorb the clearance tolerance without allowing the anchor 35 and the second core portion 36 to contact each other.

In this way, motion of the plunger rod 31 to swing like a pendulum is restricted as the sliding portion 32*d* and the rod portion 31*b* contact each other and cause sliding between them at both ends of the sliding area. This has made it possible to reduce the clearance between the anchor 35 and the second core portion 36.

When the clearance is too small, closing the suction port 38 does not bring the suction valve portion 31*a* and the suction valve seat portion 32*a* into complete surface contact with each other. This is because the sliding area clearance cannot absorb errors in the perpendicularity of the suction valve portion 31*a* and rod portion 31*b* of the plunger rod 31 and also in the perpendicularity of the suction valve seat portion 32*a* and sliding portion 32*d* of the valve seat 32. When the suction valve portion 31*a* and the suction valve seat portion 32*a* do not come into complete surface contact, the high-pressure fuel in the compression chamber 11 may subject, in a discharge phase, the plunger rod 31 to an excessive torque to possibly damage the plunger rod 31. The sliding portion may also be subjected to an excessive load to be possibly broken or worn.

Thus, when the suction port 38 is in a closed state, the suction valve portion 31*a* and the suction valve seat portion 32*a* are required to be in complete surface contact with each other. Particularly, when, as described above, the sliding length L is made large to suppress the swinging motion of the plunger rod 31, highly accurate perpendicularity is required of the suction valve portion 31*a* and rod portion 31*b* of the plunger rod 31 and also of the suction valve seat portion 32*a* and sliding portion 32*d* of the valve seat 32.

It is for this purpose that the suction valve seat portion 32*a* and the sliding portion 32*d* are provided in the valve seat 32. With the suction valve seat portion 32*a* and the sliding portion 32*d* both included in a same member, they can be made accurately perpendicular. If the suction valve seat portion 32*a* and the sliding portion 32*d* are provided as separate members, their perpendicularity is inevitably degraded when they are processed or attached with parts for coupling. Such a problem does not occur when the suction valve seat portion 32*a* and the sliding portion 32*d* are provided as a single member.

Also, when the magnetic bias force generated when the solenoid coil 53 is energized is inadequate, the amount of fuel discharged at high pressure cannot be appropriately controlled. Therefore, the magnetic circuit to be formed around the solenoid coil 53 is required to be one capable of generating an adequate magnetic bias force.

Namely, the magnetic circuit is required to be one through which, when the solenoid coil 53 is energized and a magnetic field is generated around it, as many magnetic fluxes as possible flow. Generally, when a magnetic circuit is thicker and shorter, the magnetic resistance is smaller and the magnetic fluxes passing through the magnetic circuit are larger, so that the magnetic bias force generated is larger.

In the present embodiment, the magnetic circuit includes, as shown in FIG. 5, the anchor 35, the first core portion 33, a yoke 51, and the second core portion 36 each made of a magnetic material.

The first core portion 33 and the second core portion 36 are joined together by welding at the welding portion 37*a*. It is, however, required that magnetic fluxes pass through the first core portion 33 and the second core portion 36 not directly but via the anchor 35. This is for generating a magnetic bias force between the first core portion 33 and the anchor 35. If magnetic fluxes pass through the first core portion 33 and the second core portion 36 directly, resulting in reducing the magnetic fluxes to pass through the anchor, the magnetic bias force generated becomes smaller.

Therefore, in an existing type of high pressure fuel pump, an intermediate member is provided between the first core portion 33 and the second core portion 36. Since the intermediate member is made of a non-magnetic material, fluxes pass through the first core portion 33 and the second core portion 36 not directly but only via the anchor 35.

Using such an intermediate member, however, increases the total number of components besides inviting a cost increase as it additionally becomes necessary to join the first core portion 33 and the second core portion 36 to the intermediate member.

In the present embodiment, therefore, the first core portion 33 and the second core portion 36 are directly joined at the welding portion 37 and a magnetic orifice portion 36*a* is provided in the second core portion. In the magnetic orifice portion 36*a*, the core thickness is reduced as much as allowable in terms of the core strength, whereas, in the other parts of the second core portion 36, the core thickness is adequately secured. The magnetic orifice portion 36*a* is provided to be near where the first core portion and the anchor 35 contact each other.

As a result, most of the magnetic fluxes generated pass through the anchor 37 and only a small portion of the magnetic fluxes generated directly pass through the first core portion 33 and the second core portion. This keeps reduction of the magnetic bias force to be generated between the first core portion 33 and the anchor 35 within a tolerable range.

Also, when the first core portion 33 and the anchor 35 are in contact with each other, the largest clearance in the magnetic circuit exists between the second core portion 36 and the anchor 35. The clearance is not a magnetic material and is filled with fuel, so that, when the clearance is larger, the magnetic resistance in the magnetic circuit is larger. It is, therefore, preferable that the clearance be as small as possible.

In the present embodiment, the clearance between the second core portion 36 and the anchor 35 is reduced, as described above, by making the sliding length L of the sliding portion large.

The solenoid coil 53 is formed by winding a lead wire 54 around the axis of the plunger rod 31. Both ends of the lead wire 54 are connected, by welding at a lead wire welding portion 55, to a terminal 56. The terminal is made of a conductive material and is exposed inside a connector portion 58 so as to supply an electrical current to the coil when the connector portion 58 is engaged with a mating connector from the ECU and the terminal 56 is in contact with the terminal in the mating connector.

Figure 6:
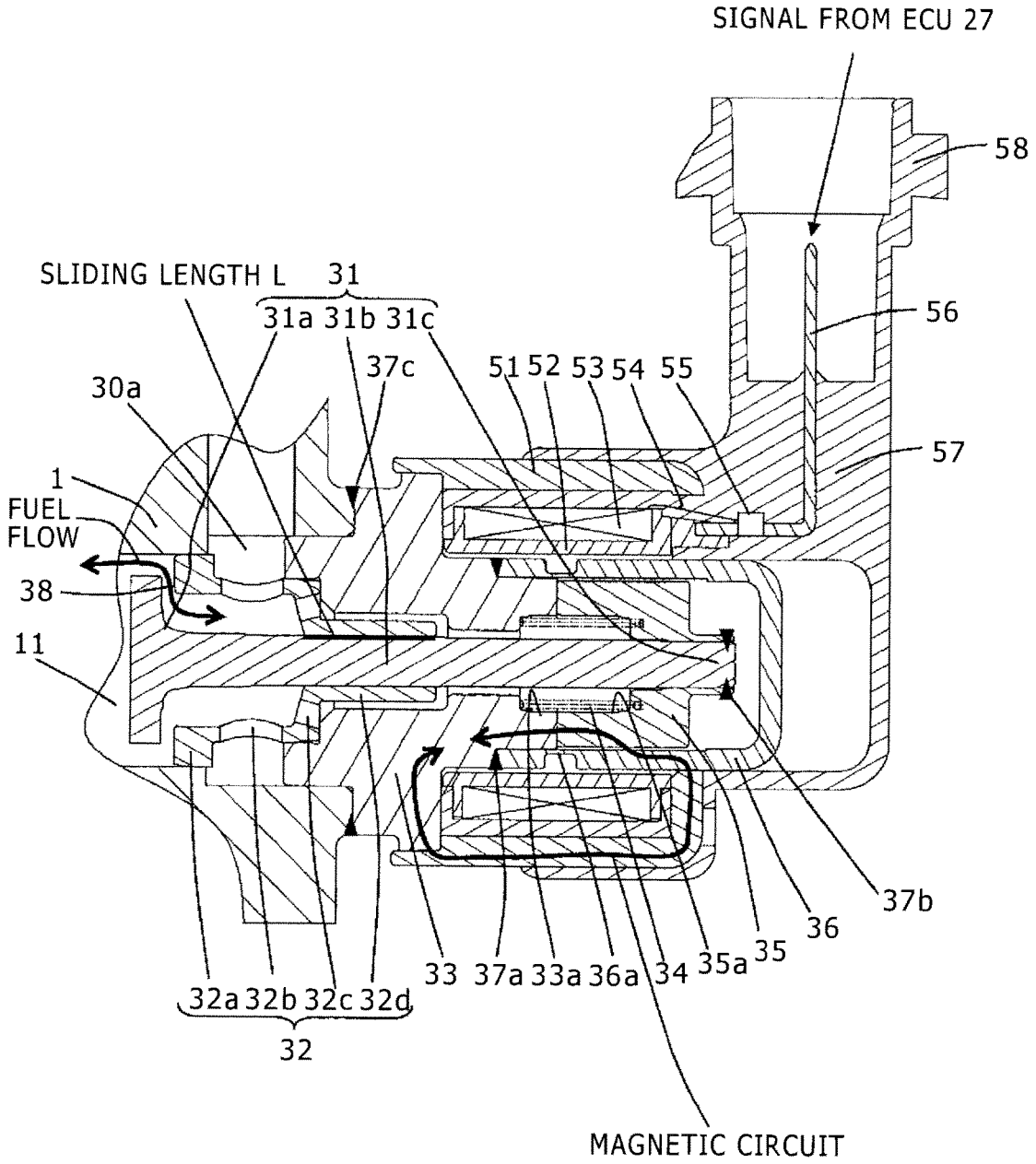
FIG. 6 is an enlarged view of the solenoid suction valve mechanism 30 in a state with the solenoid coil 52 energized of the high pressure fuel pump according to the first embodiment of the present invention.

FIG. 6 shows an existing type of structure in which the lead wire welding portion 55 is positioned inside the magnetic circuit. This increases the total length of the magnetic circuit since the volume required for the lead wire welding portion 55 is not small. As a result, the magnetic resistance in the magnetic circuit increases to pose a problem that the magnetic bias force generated between the first core portion 33 and the anchor 35 is reduced.

In the present embodiment, the lead wire welding portion 55 is positioned outside the yoke 51. In this way, the lead wire welding portion 55 is positioned outside the magnetic circuit, so that the total length of the magnetic circuit requiring no space for the lead wire welding portion 55 can be reduced. As a result, it has become possible to generate an adequate magnetic bias force between the first core portion 33 and the anchor 35.

Figure 7:
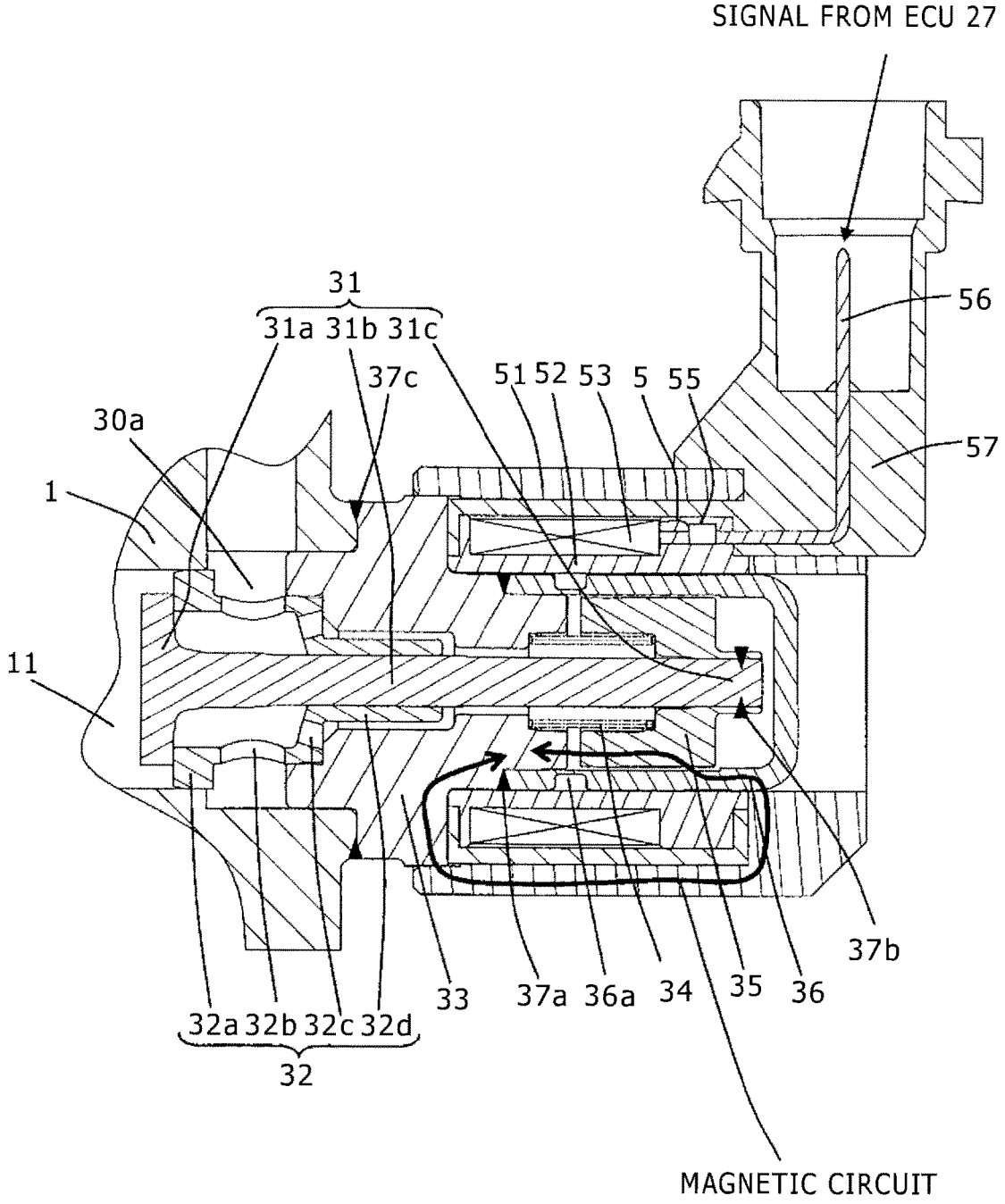
FIG. 7 is an enlarged view of a solenoid suction valve mechanism 30 in a state with a solenoid coil 52 unenergized according to an existing type of high pressure fuel pump.

FIG. 7 shows the solenoid suction valve mechanism 30 before being mounted in the pump housing 1.

In the present embodiment, first, a suction valve unit 37 and a connector unit 38 are prepared as discrete units. Next, the suction valve seat portion 32*a* of the suction valve unit 37 is fixedly press-fitted into the pump housing 1, then the welding portion 37*c* is wholly circumferentially welded for connection. This is done by laser welding in the present embodiment. In this state, the connector 38 is fixedly press-fitted to the first core portion 33. In this way, the connector 58 can be oriented as desired.

The pump housing 1 has the concave portion 1A for accommodating the cylinder 6 including the compression chamber 11. A hole 11A for mounting a discharge valve mechanism 8 is formed to be open to the compression chamber 11 in a direction intersecting with the concave portion 1A for accommodating the cylinder 6.

The discharge valve mechanism 8 is positioned at the outlet of the compression chamber 11. The discharge valve mechanism 8 includes a seat member (seat member) 8*a*, a discharge valve 8*b*, a discharge valve spring 8*c*, and a retaining member 8*d* to serve as a discharge valve stopper. The discharge valve mechanism 8 is assembled by welding a welding portion 8*e* outside the pump housing 1. Subsequently, the discharge valve mechanism 8 thus assembled is fixedly press-fitted, from the left side as seen in the diagram, to the pump housing 1. The press-fitted portion has a function to isolate the compression chamber 11 and the discharge port 12 from each other.

When there is no fuel pressure difference between the compression chamber 11 and the discharge port 12, the discharge valve 8*b* is closed by being pressed against the seat member 8*a* by the bias force of the discharge valve spring 8*c*. Only when the fuel pressure in the compression chamber 11 exceeds the fuel pressure in the discharge port 12 by a predetermined value or more, the discharge valve 8*b* opens by overcoming the bias force of the discharge valve spring 8*c*. As a result, the fuel in the compression chamber 11 is discharged into the common rail 23 via the discharge port 12.

When the discharge valve 8*b* opens, its movement is limited by coming into contact with the retaining member 8*d*. Namely, the stroke of the discharge valve 8*b* is appropriately defined by the retaining member 8*d*. If the stroke is too large, the discharge valve 8*b* cannot close quickly enough. This causes part of the fuel discharged to the fuel discharge port 12 to return into the compression chamber 11, resulting in lowering the efficiency of the high pressure pump. The retaining member 8*d* also serves as a guide to allow the discharge valve 8*b* to repeat opening and closing by moving only in the stroke direction. The discharge valve mechanism 8 structured as described above can serve as a check valve for restricting the fuel flow direction.

The cylinder 6 having a ceiling portion 6A is shaped like a bottomed cup. The inner periphery of the cylindrical member making up the cylinder has a concave portion formed to be the compression chamber 11.

The cylinder 6 has plural circumferentially distributed through-holes 6*a* through which the compression chamber 11 and the suction port 38 are communicated with each other and plural circumferentially distributed through-holes 6*b* through which the compression chamber 11 and the fuel discharge port 12 are communicated with each other.

The outer cylindrical surface (outer periphery) of the cylinder 6 fits on the inner cylindrical surface (inner periphery) of the concave portion 1A formed in the pump housing 1, and the cylinder 6 is press-fitted by a press-fitting portion 6*c* to be held in the pump housing 1.

The cylinder 6 is fixed at two positions, i.e. at fitting portions 6*c* and 6*d* on the inner cylindrical surface (inner periphery) of the pump housing 1. In this way, the coaxialness between the center axes of the pump housing 1 and cylinder 6 is improved.

With the press-fitting portions 6*c* and 6*d* positioned away from where the cylinder 6 and the plunger 2 slide against each other, coaxialness degradation due to press-fitting can be inhibited.

A hole 10*d* communicating with the low-pressure fuel chamber 10*c* is formed through a ceiling portion 10A above the inner cylindrical surface (inner periphery) of the pump housing 1. When the cylinder 6 is press-fitted into the pump housing 1, the ceiling portion 10A serves as an air vent hole. With the air vent hole 10*d* provided, the load applied to the cylinder 6 when the cylinder 6 is press-fitted can be reduced and deformation due to buckling of the cylinder 6 can be prevented.

The diameter of the communication hole 10*d* is smaller than the outer diameter of the cylinder 6, so that the communication hole 10*d* functions as a stopper to prevent the cylinder 6 from coming out to the low-pressure fuel chamber 10*c* side.

When diameter D of the communication hole 10*d* is such that the relationship of "area AD>ADc−Ad" is maintained, even if high-pressure fuel passes through where the cylinder 6 and the pump housing 1 are fitted together, the high-pressure fuel is released into the low-pressure fuel chamber. Therefore, the cylinder 6 is kept fixed without being forced to get out of the pump housing 1 by a pressure difference.

With the cylinder 6 shaped like a cup, the top end portion of the ceiling portion 6A of the cylinder 6 is pressed against the ceiling portion 10A of the pump housing 1 by the pressure in the compression chamber 11, thereby effecting metal-to-metal sealing.

The effect of the metal-to-metal sealing increases as the pressure in the compression chamber 11 increases.

A plunger seal 13 is held at the lower end of a spring holder 7 by a seal holder 15 fixedly press-fitted to an inner peripheral cylindrical surface 7*c* of the spring holder 7 and the spring holder 7. The center axis of the plunger seal 13 is held coaxial with the center axis of the inner peripheral cylindrical surface 7*c* of the spring holder 7 as well as with the center axis of a cylindrical fitting portion 7*e*. The plunger 2 and the plunger seal 13 are installed to be slidable against each other in a lower end portion of the cylinder 6.

The plunger seal 13 prevents the fuel in a sealed chamber 10*f* from leaking into the engine mounted on the tappet 3 side, while also preventing the lubricant oil (including engine oil) lubricating sliding parts in the engine room from leaking into the pump body 1.

The spring holder 7 is mounted by fitting the outer cylindrical surface (outer periphery) portion 7*e* thereof to an inner cylindrical surface (inner periphery) portion in a lower portion of the pump housing 1. In the present embodiment, the spring holder 7 is fixed by laser welding.

The pump housing 1 has, on an outer peripheral cylindrical surface 7*b* thereof, a groove 7*d* for having an O-ring 61 fitted therein. The O-ring 61 fitted between the inner wall surface of a fitting hole 70 on the engine side and the groove 7*d* of the pump housing 1 isolates the cam side portion of the engine from outside to prevent the engine oil from leaking to the outside.

In the above-described structure, the cylinder 6 can slidably retain the plunger 2 reciprocally moving in the compression chamber 11 along the direction of the reciprocal motion.

The plunger 2 is, at the lower end thereof, provided with a tappet 3 which converts the rotational motion of a cam 5 mounted on a cam shaft of the engine into up-and-down motion and conveys the up-and-down motion to the plunger 2. The plunger 2 is pressed against the tappet 3 by the spring 4 via the retainer 15. The retainer 15 is fixedly press-fitted to the plunger 2. In this structure, rotation of the cam 5 causes the plunger 2 to move (reciprocate) up and down.

With the low-pressure fuel chamber 10*c* connected to the sealed chamber 10*f* via the suction flow path 10*d* and a suction flow path 10*e* which is provided in the cylinder holder 7, the sealed chamber 10*f* is always connected with the pressure of the sucked-in fuel. When the fuel in the compression chamber 11 is pressurized to a high pressure, a very small amount of high-pressure fuel leaks into the sealed chamber 10*f* through the sliding portion clearance between the cylinder 6 and the plunger 2. However, since the leaked-in high-pressure fuel is released into the suction pressure, breakage due to a high pressure of the plunger seal 13 does not occur.

The plunger 2 includes a large-diameter portion 2*a* which slides against the cylinder 6 and a small-diameter portion 2*b* which slides against the plunger seal 13. The large-diameter portion 2*a* is larger in diameter than the small-diameter portion 2*b*, and the two portions are coaxial with each other. The plunger 2 slides against the cylinder 6 at the large-diameter portion 2*a* and against the plunger seal 13 at the small-diameter portion 2*b*. In this structure, with the border between the large-diameter portion 2*a* and the small-diameter portion 2*b* staying in the sealed chamber 10*f*, the volume of the sealed chamber 10*f* changes with the sliding motion of the plunger 2. This causes the fuel to moves back and forth between the sealed chamber 10*f* and the suction flow path 10*c* via the suction flow paths 10*d* and 10*s*.

As the plunger 2 repeats sliding against the plunger seal 13 and the cylinder 6, friction heat is generated, causing the large-diameter portion 2*a* of the plunger 2 to be thermally expanded. Of the large-diameter portion 2*a*, the plunger seal 13 side thereof is closer to the friction heat source than the compression chamber 11 side thereof. This causes the large-diameter portion 2*a* to be thermally expanded unevenly. As a result, the coaxialness between the plunger 2 and the cylinder 6 is degraded possibly causing seizure between them.

In the present embodiment, the sliding motion of the plunger 2 causes the fuel in the sealed chamber 10*f* to be constantly replaced, so that the fuel has a heat removal effect. This prevents deformation due to friction heat of the large-diameter portion 2*a* and seizure between the plunger 2 and the cylinder 6 which may result from deformation of the large-diameter portion 2*a*.

Furthermore, the smaller the diameter of the plunger 2 portion to slide against the plunger seal 13, the smaller the area of friction between them and, hence, the smaller the amount of friction heat generated by the sliding motion of the plunger 2. In the present embodiment, the plunger 2 portion to slide against the plunger seal 13 is the small-diameter portion 2*b* of the plunger 2, so that the amount of friction heat generated by the sliding of the plunger 2 against the plunger seal 13 can be held small. This prevents seizure between the plunger 2 and the cylinder 6.

The metal diaphragm damper 9 includes two metal diaphragms which are fixed to each other by completely welding, at a welding portion, their outer peripheries with a gas sealed in the space between them. When both sides of the metal diaphragm damper 9 are subjected to low-pressure pulsation, the metal diaphragm damper 9 changes its volume and, thereby, reduces the low-pressure pulsation.

The high pressure fuel pump is fixed to the engine using a flange 41, locking screws 42, and bushes 43. The flange 41 is completely circumferentially connected to the pump housing 1 by welding at a welding portion 41*a*. In the present embodiment, laser welding is used.

Figure 8:
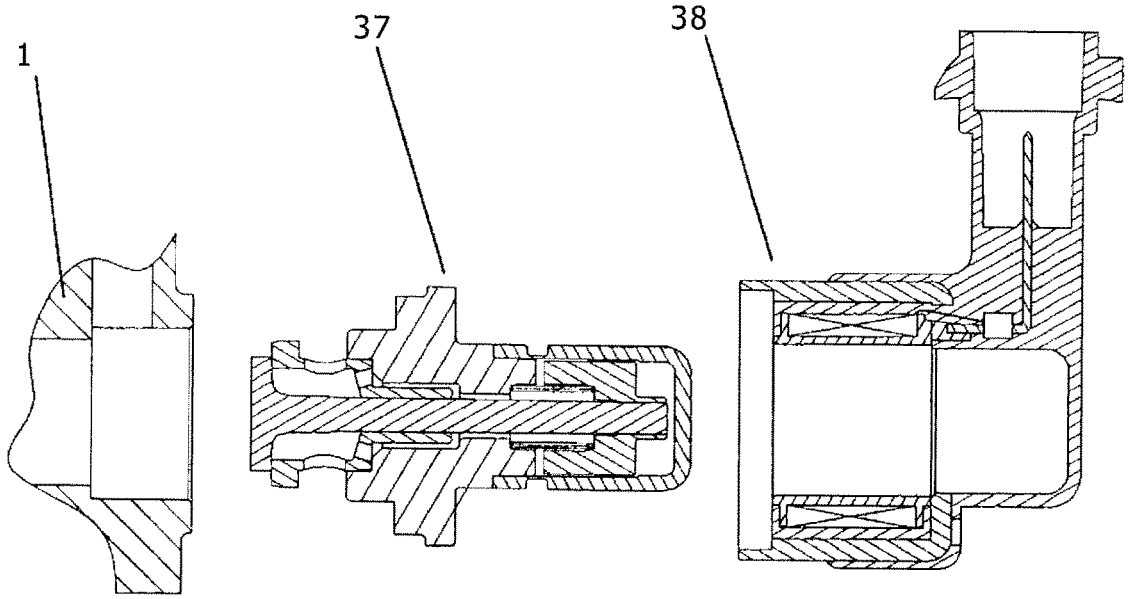
FIG. 8 shows the solenoid suction valve mechanism 30 in a sub-assembled state before being mounted in the pump housing 1 of the high pressure fuel pump according to the first embodiment of the present invention.

FIG. 8 is an external view of the flange 41 and the bushes 43. No other component than the flange 41 and bushes 43 is shown in FIG. 8.

The two bushes 43 are fixed to the side opposite to the engine of the flange 41. The two locking screws 42 are screwed into the corresponding threaded holes formed on the engine side, respectively, thereby pressing the two bushes 43 and the flange 41 against the engine to fix the high pressure fuel pump to the engine.

Figure 9:
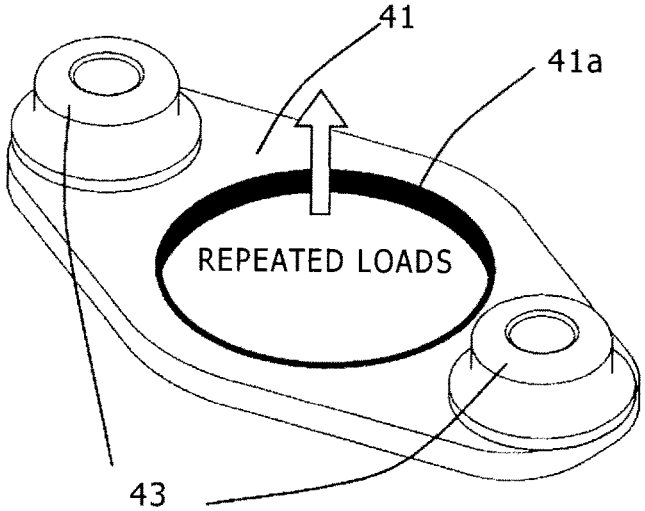
FIG. 9 is an external view of a flange 41 and bushes 43 included in the high pressure fuel pump according to the first embodiment of the present invention. No other component than the flange 41 and bushes 43 is shown in FIG. 9.
Figure 10:
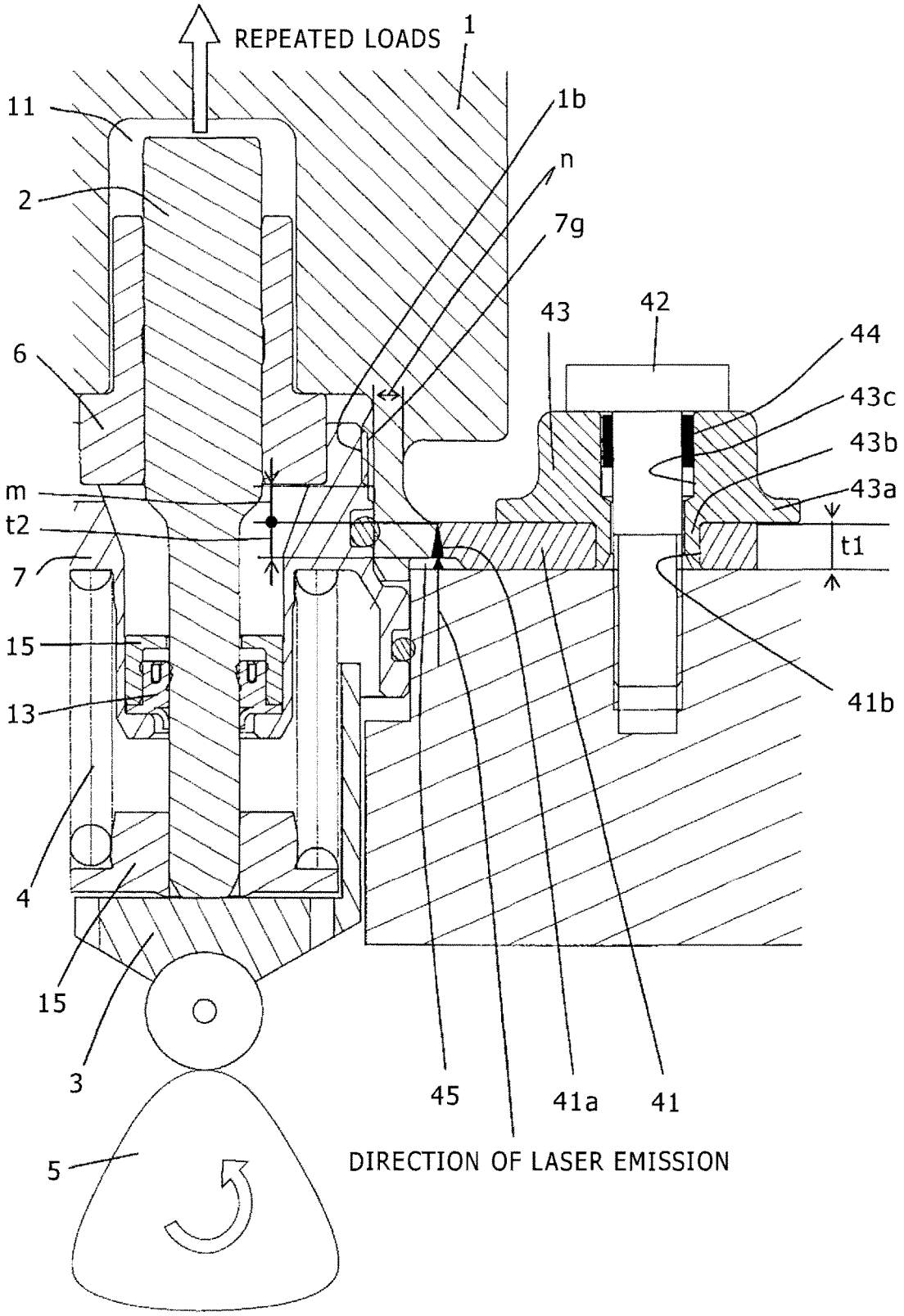
FIG. 10 is an enlarged view of a portion around a welding portion 41*a* of the high pressure fuel pump according to the first embodiment of the present invention.
Figure 11:
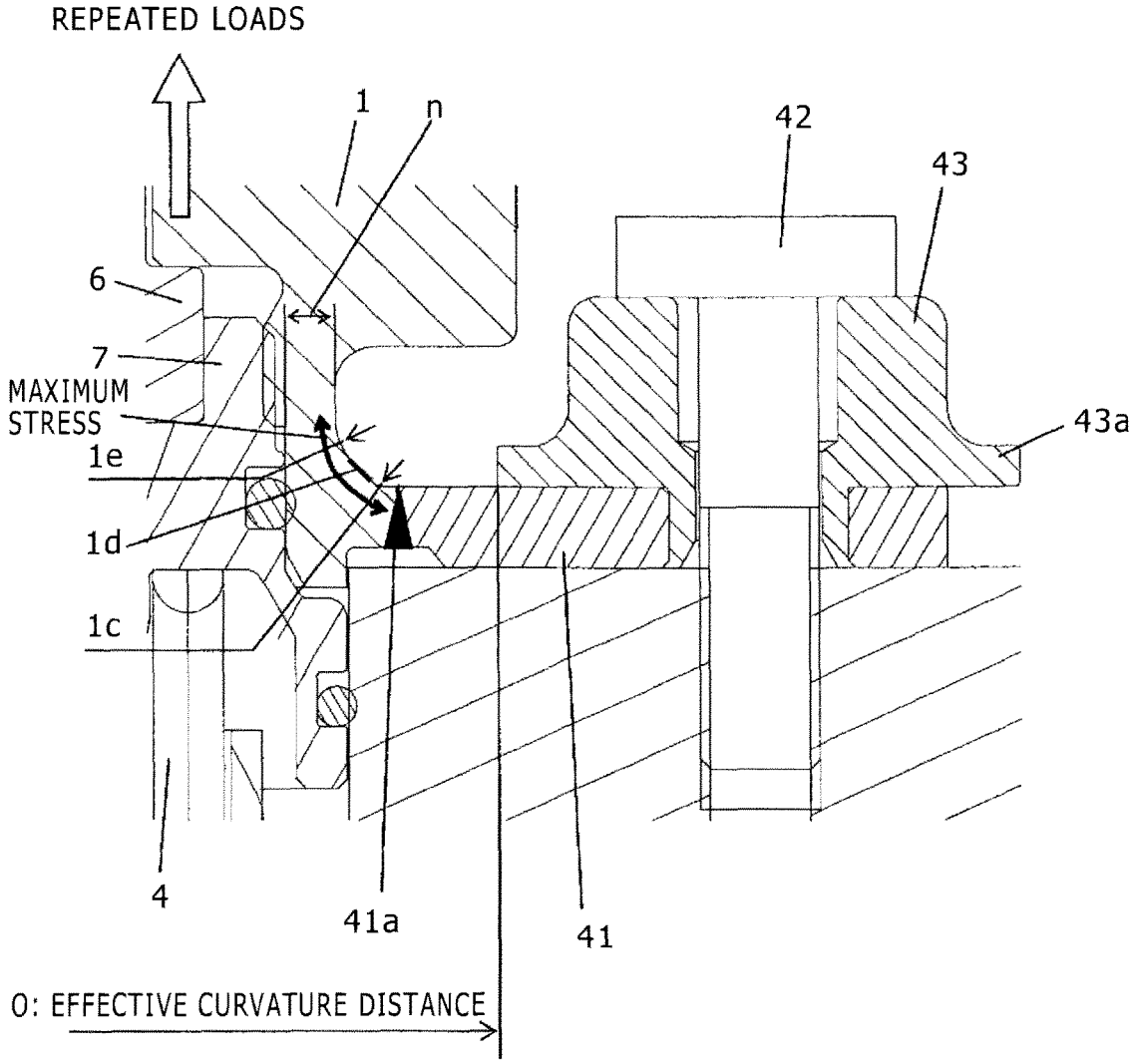
FIG. 11 is an enlarged view, more enlarged than FIG. 11, of a portion around the welding portion 41*a* of the high pressure fuel pump according to the first embodiment of the present invention.

FIG. 9 is an enlarged view of a portion including the flange 41, a locking screw 42, and a bush 43.

The bush 43 includes a brim portion 43*a* and a caulking portion 43*b*. The caulking portion 43*b* is fixedly caulked into a fixing hole formed in the flange 41. The bush 43 is subsequently coupled to the pump housing 1 via the flange 41 by laser welding at the welding portion 41*a*. Subsequently, a fastener 44 made of resin is fitted into the bush 43, then the locking screw 42 is inserted through the fastener 44. The fastener 44 serves to temporarily fix the locking screw 42 to the bush 43 so as not to allow the locking screw 42 to be released from the bush 43 before the high pressure fuel pump is mounted to the engine. When fixing the high pressure fuel pump to the engine, the locking screw 42 is fixed by screwing into a threaded portion on the engine side. At this time, the locking screw can be turned in the bush 43 by applying a fastening torque thereto.

When the high pressure fuel pump repeatedly pumps out high-pressure fuel, the pressure in the compression chamber 11 repeats increasing to a high pressure and decreasing to a low pressure. When the pressure in the compression chamber 11 is high, the high pressure causes the pump housing 1 to be subjected to an upward force as seen in the figure. The pump housing 1 is not subjected to such an upward force when the pressure in the compression chamber 11 is low. Namely, the pump housing is repeatedly subjected to an upward force as seen in the figure.

As shown in FIG. 9, the pump housing 1 is fixed to the engine via the flange 41 using the two locking screws 42. Therefore, when the pump housing 1 is repeatedly subjected to an upward force as described above, the flange 42 with side portions thereof clamped by the two locking screws 42 and two bushes 43 is repeatedly subjected to a bending load at a central portion thereof. There used to be a problem that such repeated loads deform the flange 41 and the pump housing 1 resulting in generating repeated stresses to eventually cause the flange 41 and the pump housing 1 to be broken by fatigue. Furthermore, the sliding portion of the cylinder 6 can also be deformed to cause seizure between the plunger 2 and the cylinder 6 as described in the foregoing.

For a productivity reason, the flange 41 is formed by pressing. The flange 41, therefore, has a limited plate thickness t1 which is, in the present example, 4 mm. The pump housing 1 and the flange 42 are joined together by laser welding at the welding portion 41. The laser welding requires a beam to be emitted from the lower side as seen in the figure. This is because, with other components disposed above the welding portion 41, a downward beam emitted from the upper side as seen in the figure cannot completely circumferentially irradiate the welding portion 41. Furthermore, the laser welding beam must penetrate through the plate thickness t=4 mm of the flange 41. Otherwise, the laser welding will result in causing the welding portion to have notches in edge portions thereof. This will allow stress generated by repeated loads as described in the foregoing to concentrate on the notches to eventually cause a fatigue breakdown.

Using a large laser output makes penetration laser welding of the flange 41 possible. However, welding always generates heat, so that the flange 41 may be thermally deformed. Also, a large amount of spatters generated by welding adhere to the pump housing 1 and other components. From this point of view, the weld length to be penetrated by laser welding is desired to be as short as possible.

Hence, in the present embodiment, only the welding portion 41*a* has a plate thickness of t2=3 mm. This makes penetration laser welding of the flange 41*a* possible while minimizing spatter generation. Since the welding portion 41*a* with a plate thickness t2=3 mm can be formed by pressing, high productivity can be achieved.

The step formed by the difference between plate thickness t2=3 mm of the welding portion 41*a* and plate thickness t1=4 mm is on the engine side of the welding portion 41*a*. Namely, a concave portion 45 is formed. When the welding portion 41*a* is welded, the top and bottom surfaces thereof bulge from the base material. The concave portion 45 prevents the bulge formed on the bottom surface of the welding portion 41*a* from interfering with the engine. The bulge if in contact with the engine when the high pressure fuel pump is fixed to the engine with the locking screws 42 causes the flange 41 to be subjected to a bending stress, possibly resulting in breakage of the flange 41.

As described above, the flange 41 can be prevented from being broken by repeated loads generated when the fuel is repeatedly pumped out at high pressure. The flange 41 can also be prevented from being broken as a result of contact between the bulge on the welding portion 41*a* and the engine.

As described above, when the pump housing 1 is subjected to repeated loads, the pump housing 1 clamped by the two locking screws 42 and two bushes 43 is curved along the direction of the repeated loads. With the welding portion 41*a* penetratingly laser welded completely circumferentially, the curving of the flange 41 spreads to the pump housing 1. The cylinder holder 7 and the pump housing 1 are, on the other hand, in contact with each other only at threaded portions 7*g* and 1*b*. The threaded portion 1*b* of the pump housing 1 and the welding portion 41*a* are apart from each other by distance m. The minimum thickness of the pump housing 1 at a portion thereof at distance m from the welding portion 41*a* is n. The values of m and n are determined such that, even if the pump housing 1 is deformed due to curving of the flange 41, the deformation is absorbed by the portion at distance m from the welding portion 41*a* and with a thickness n of the pump housing 1 not to allow the deformation to spread to the threaded portion 1*b*.

In the above-described way, deformation of the cylinder 6 due to curving of the flange 41 can be prevented. In this way, however, the curving of the flange 41 is required to be absorbed entirely by the pump housing 1 and, if the stress repeatedly generated in the pump housing 1 exceeds a tolerable value, the pump housing 1 may be broken down by fatigue to result in a fuel leakage.

There are two methods for preventing such fatigue breakdown of the pump housing 1.

(1) Shaping pump housing 1 such that stress generation does not exceed tolerable value (2) Reducing curving of flange 41

The two methods will be described below.

First, method (1) will be described. FIG. 9 shows an enlarged view of a portion around the welding portion 41*a*. When the pump housing 1 is pulled upward, as seen in the figure, by repeated loads and the flange 41 is curved causing stress generation, the maximum stress is generated on the surface of the pump housing 1 in the directions indicated by the double-headed arrow denoted as "MAXIMUM STRESS" in FIG. 10. The pump housing 1 is required to be shaped to achieve an effect of distributing, to a maximum extent possible, the stress generated therein so as not to allow stress concentration.

In the present embodiment, curved portions 1*c* and 1*e* are connected via a linear portion 1*d* as shown in the figure and, based on this structure, optimum values have been determined. The stress generated on the linear portion 1*d* formed between the two curved portions 1*c* and 1*e* is uniformly distributed. As a result, stress concentration has been avoided and the maximum stress generated has been reduced.

Next, method (2) will be described. To reduce the curving of the flange 41, there is no other method than increasing the rigidity of the flange 41. As mentioned in the foregoing, it is very difficult, from a productivity point of view, to make the plate thickness t of the flange 41 larger than 4 mm. It has, therefore, been determined to increase the diameter of each bush 43 provided only to fix a locking screw 42. In the following, an effective curvature distance O represents the shortest distance between end portions of the two bushes 43, i.e. the portion actually curved by repeated loads. Reducing the effective curvature distance O results in increasing the rigidity of the flange 41.

In the present embodiment, each bush 43 has a brim portion 43*a* to reduce the effective curvature distance O. As for the height, each bush 43 is required to be at least high enough to allow insertion of the fastener 44. If each bush 43 having such a height and having no brim portion is enlarged in outer diameter, problems are caused such as interference with the pump housing 1 and an increase in the amount of material of the bush 43. Providing each bush 43 with a brim portion 43*a* has made it possible to prevent such problems and reduce the effective curvature distance O.

Methods (1) and (2) have been achieved by adopting the above-described structure making it possible to keep the stresses repeatedly generated in the pump housing 1 at or below a tolerable value.

Second Embodiment

Figure 12:
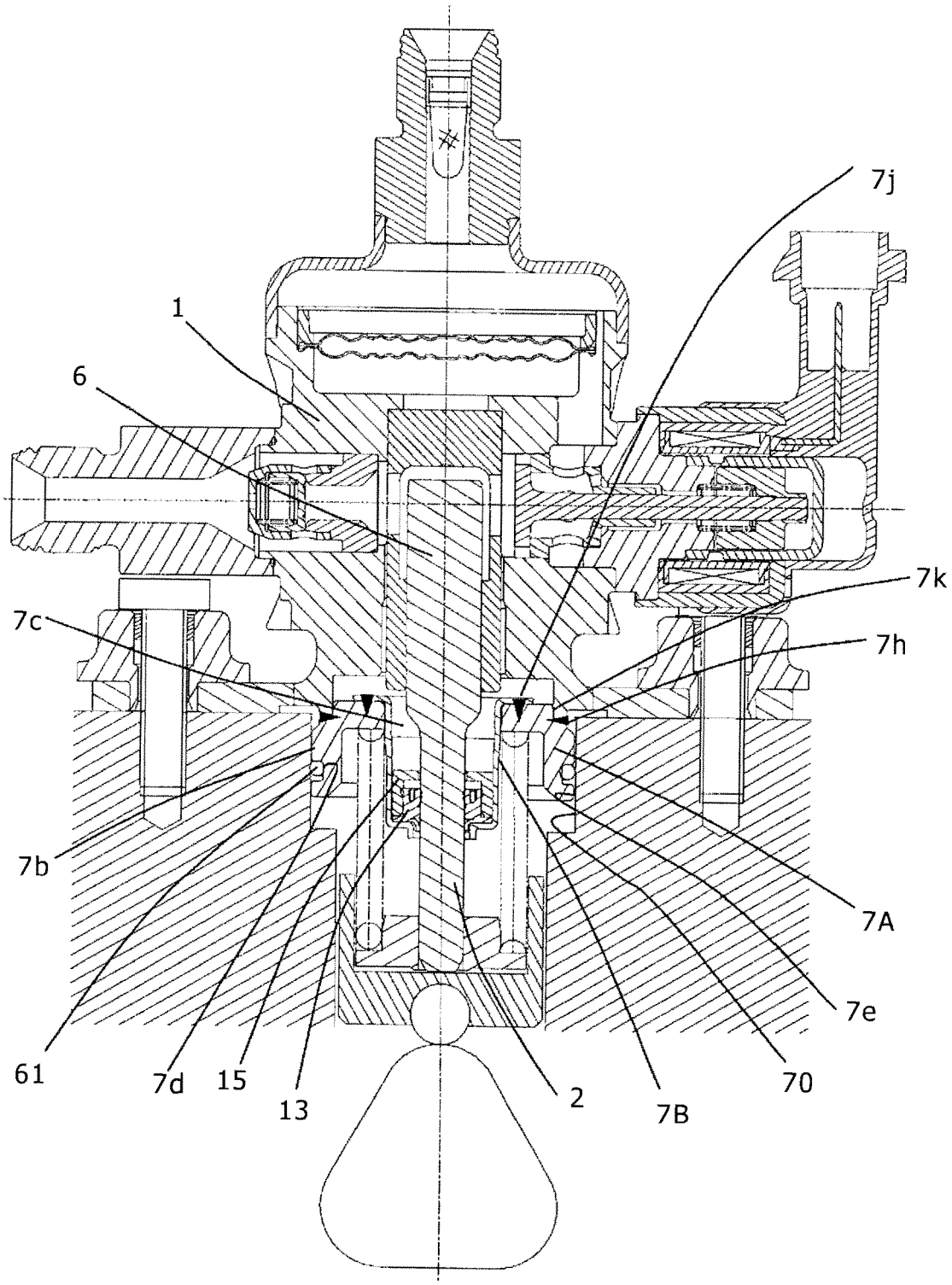
FIG. 12 is a vertical sectional view of a high pressure fuel pump according to a second embodiment of the present invention.

The structure of a second embodiment of the present invention will be described below with reference to FIG. 12.

In the present embodiment, the external shape of the pump housing 1 is made smaller by using a discrete spring holder 7A and a discrete plunger seal holder 7B for a cost reduction.

The spring holder 7A is provided, on an outer cylindrical portion 7*b* thereof, with a groove 7*d* for fitting an O-ring 61. The O-ring 61 is held between the inner wall of a fitting hole on the engine side and the groove 7*d* of the spring holder 7A and isolates the cam side of the engine from outside so as to prevent the engine oil from leaking to the outside.

The plunger seal holder 7B and the cylinder holder 7A are fixed to each other before being fixed in the pump housing 1. In the present embodiment, they are fixed by laser welding 7*j* and seal the fuel.

The outer peripheral cylindrical surface portion 7*k* of the spring holder 7A is press-fitted to the inner peripheral cylindrical surface portion of the pump housing 1 and is fixed there by laser welding 7*h* to seal the fuel.

The plunger seal 13 is held at the lower end of the spring holder 7A by the seal holder 15 fixedly press-fitted to the inner peripheral cylindrical surface of the plunger seal holder 7B and the spring holder 7A. The plunger seal 13 is held, by the inner peripheral cylindrical surface 7*c* of the spring holder 7A, coaxial with the cylindrical fitting portion 7*e*. The plunger 2 and the plunger seal 13 are installed to be slidable against each other in a lower end portion of the cylinder 6 as seen in the figure.

Third Embodiment

Figure 13:
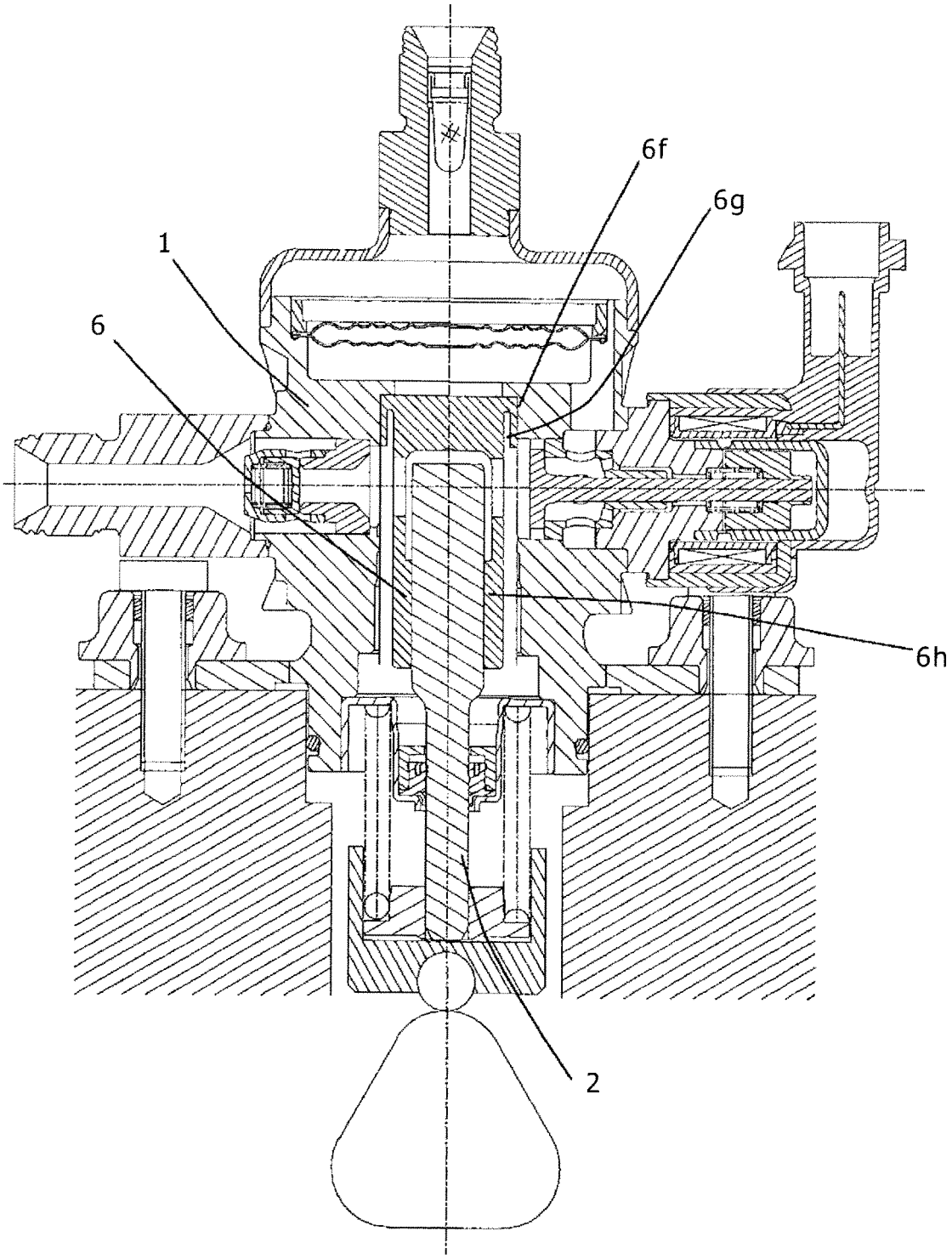
FIG. 13 is a vertical sectional view of a high pressure fuel pump according to a third embodiment of the present invention.

Next, the structure of a third embodiment of the present invention will be described with reference to FIG. 13.

The cylinder 6 has, on the outer peripheral surface portion thereof, a step portion 6*f* including two or more steps each formed of a large-diameter portion and a small-diameter portion. The step portion 6*f* has a cylindrical groove 6*g* formed coaxially with the inner cylindrical side surface (inner periphery) of the cylinder 6. The cylindrical groove 6*g* absorbs strain generated when the cylinder 6 is press-fitted into the pump housing 1 or generated as a result of thermal expansion of the cylinder 6. This inhibits degradation of the coaxialness of a sliding surface 6*h*, against which the plunger 2 slides, on the inner peripheral surface of the cylinder 6 and sticking between the plunger 2 and the sliding surface 6*h*.

Fourth Embodiment

Figure 14:
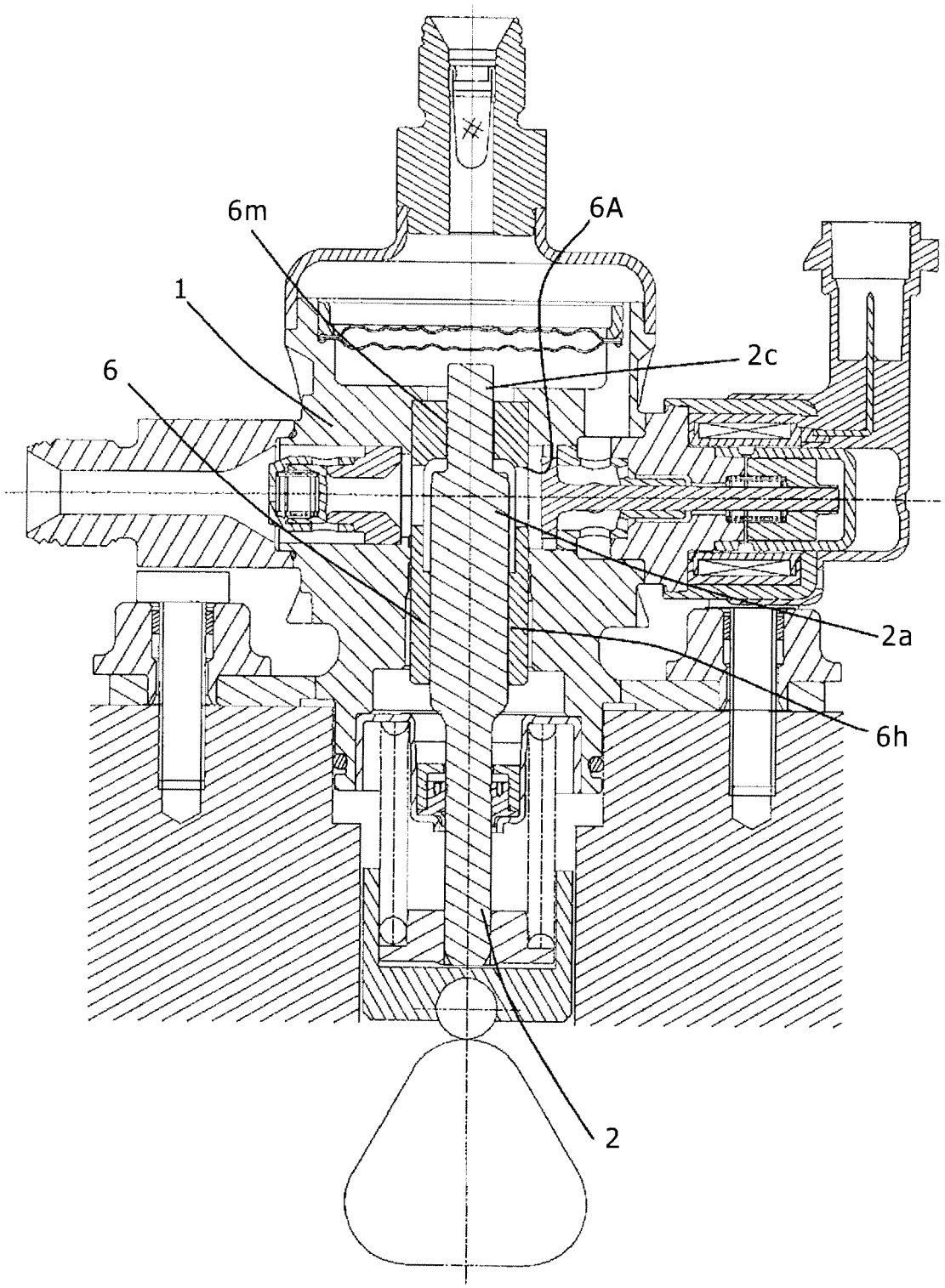
FIG. 14 is a vertical sectional view of a high pressure fuel pump according to a fourth embodiment of the present invention.

Next, the structure of a fourth embodiment of the present invention will be described with reference to FIG. 14.

The ceiling portion 6A of the cylinder 6 includes a sliding portion 6*m* smaller in diameter than the large-diameter portion 2*a* of the plunger 2. The sliding portion 6*m* is formed coaxially with the sliding portion 6*h* on the large-diameter portion 2*a* of the plunger 2.

The plunger 2 includes, in a top portion thereof, a coaxial small-diameter portion 2*c*. The small-diameter portion 2*c* is fitted to the sliding portion 6*m* provided in the ceiling portion 6A of the cylinder 6. This increases the area of sliding between the plunger 2 and the cylinder 6. As a result, shifting and inclination of the axis of the plunger 2 is reduced, and sticking and adhesion of the plunger 2 is reduced.

Fifth Embodiment

Figure 15:
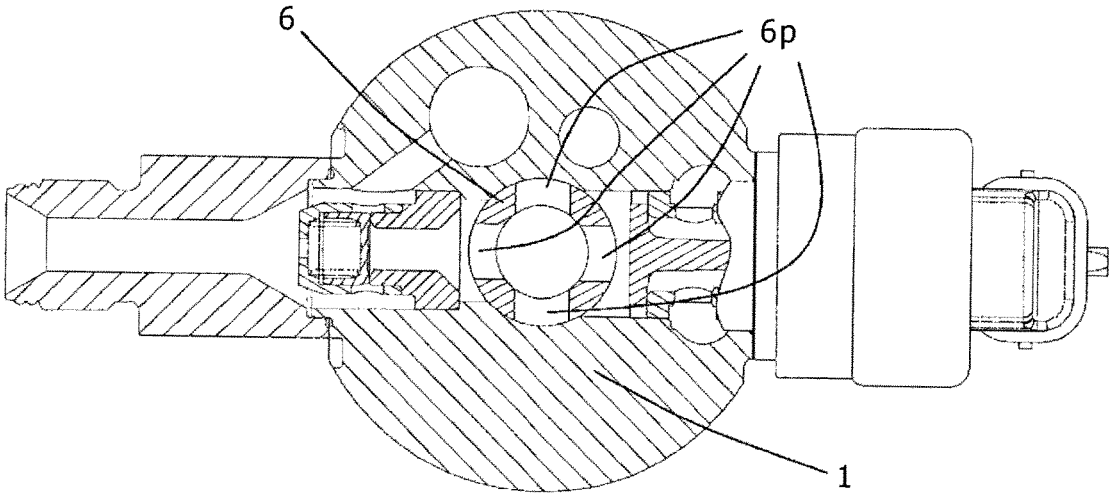
FIG. 15 is a vertical sectional view of a high pressure fuel pump according to a fifth embodiment of the present invention.
Figure 16:
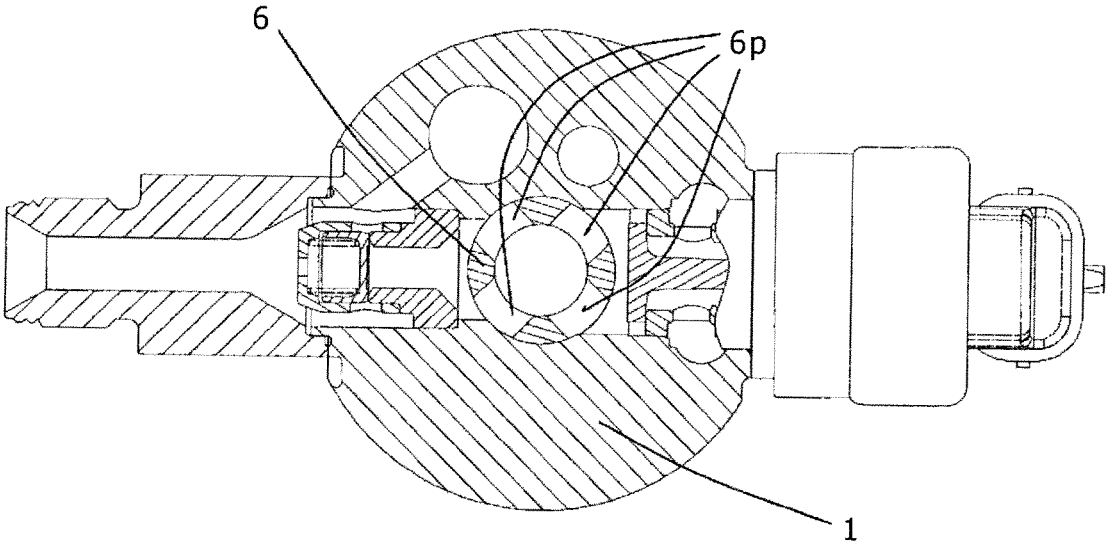
FIG. 16 is a vertical sectional view of the high pressure fuel pump according to the fifth embodiment of the present invention, differing from FIG. 15 in cylinder fixed position.

Next, the structure of a fifth embodiment of the present invention will be described with reference to FIG. 15.

In this embodiment, the cylinder 6 has plural transversal holes 6*p* forming fuel paths (6*a*, 6*b*) through the side portion of the cylinder 6. The transversal holes 6*p* forming fuel paths (6*a*, 6*b*) are distributed in two or more positions such that, regardless of the circumferential position where the cylinder 6 is fixed, the fuel can flow through from the suction path to the discharge path.

The features of the above embodiments can be summarized as follows.

(1) A hole is formed in the ceiling portion of the pump housing.

The hole serves as an air vent hole when the cylinder cup is press-fitted into the pump housing. When no air vent hole is provided, press-fitting the cylinder requires application of a load on the order of several tons. In such a case, the body housing and the cylinder will be deformed. In the foregoing embodiments, the rated load for press-fitting the cylinder is 1 ton and, in normal cases, the cylinder can be press-fitted by applying a load of up to 8000 N.

(2) The higher the pressure applied to the interior of the cylinder, the higher the surface pressure of the contact seal surface between the outer periphery of the cylinder and the inner periphery of the pump housing resulting in higher sealability.

(3) The outer cylindrical portion (outer periphery) of a cup-shaped cylinder member is fixedly press-fitted to the inner cylindrical portion (inner periphery) of the pump housing by applying a force such that, during a suction stroke of the plunger, the pressure difference between outside and inside the cylinder does not force the cylinder to come out of the pump housing.

(4) The cylinder is shaped like a cup with a ceiling, and a hole is formed between the cylinder and the low-pressure chamber side of the pomp body ceiling portion. The hole has a diameter D which holds the relationship of "area AD of hole D>outer diameter area ADc of cylinder–outer diameter area Ad of plunger." This can certainly prevent the pressure in the cylinder from generating a force in the direction for downwardly letting the cylinder come out of the pump housing.

(5) The press-fitting surface is formed to be closer to the ceiling than the inner-diameter finished portion of the cylinder, so that the inner diameter is not deformed by press-fitting.

LIST OF REFERENCE SIGNS

1 Pump housing
1A Concave portion
2 Plunger
6 Cylinder
6A Ceiling portion (of cylinder)
10A Ceiling portion (of pump housing)
11 Compression chamber
30 Solenoid suction valve mechanism

The invention claimed is:

1. A fuel pump comprising:

a pump housing having a concave portion formed therein, a cylinder fitted in the concave portion of the pump housing and defining a compression chamber of the pump, and a plunger pressurizing, by sliding against the cylinder, fuel in the compression chamber, the fuel pump pressurizing fuel which is sucked into the compression chamber by reciprocating motion of the plunger, then discharging the fuel from the compression chamber;

a plunger seal that is slidably installed to the plunger; and a plunger seal holder that holds the plunger seal, wherein the cylinder is formed of a cylindrical member which has a ceiling portion and in which the compression chamber is partitionedly formed, wherein a fuel suction path formed in the pump housing reaches the compression chamber through the cylinder and a fuel discharge path formed in the pump housing is connected to the compression chamber through the cylinder, wherein the cylinder has an outer peripheral surface portion including a press-fitting portion, wherein the cylinder is fixed to the pump housing by press-fitting the outer peripheral surface portion at the press-fitting portion to an inner peripheral surface portion of the pump housing, wherein a lower side portion of the cylinder, which is formed farther from the ceiling portion of the cylinder than from the press-fitting portion of the cylinder, is radially clearanced from the inner peripheral surface portion of the pump housing, the lower side portion and the press-fitting portion being different portions of the cylinder, wherein the cylinder has a concave portion formed in the ceiling portion and above an inner opening of a through-hole which is formed at an inner peripheral surface of the cylinder, and the concave portion of the cylinder is concave with respect to the plunger, and wherein the cylinder is press-fitted into the pump housing without the plunger seal holder being in contact with the cylinder in an installed position.

2. The fuel pump according to claim 1, wherein a ceiling portion of the concave portion of the pump housing has a hole formed therein, and wherein the hole is covered by an outer surface of the ceiling portion of the cylinder fitted in the concave portion of the pump housing.

3. The fuel pump according to claim 2, wherein the hole has a diameter smaller than an outer diameter of the cylinder.

4. The fuel pump according to claim 1, wherein a reaction force of a pressure generated by compressing motion of the plunger in the compression chamber of the cylinder pushes the cylinder toward an inner wall surface of a ceiling portion of the pump housing.

5. The fuel pump according to claim 1, wherein a seal portion is formed between the outer peripheral surface portion of the cylinder and the inner peripheral surface portion of the pump housing.

6. The fuel pump according to claim 5, wherein the seal portion is a metallic sealing portion formed for sealing by metallic contact between the outer peripheral surface portion of the cylinder and the inner peripheral surface portion of the pump housing.

7. The fuel pump according to claim 1, wherein the outer peripheral surface portion of the cylinder has a step portion including two or more steps each formed of a large-diameter portion and a small-diameter portion, the large-diameter portion of the step portion fitting to the inner peripheral surface of the pump housing and having an inner annular groove.

8. The fuel pump according to claim 1, wherein the ceiling portion of the cylinder has an opening portion and the plunger has, on an upper end surface thereof, a shaft portion smaller in diameter than an outermost diameter of the plunger, the opening portion and the shaft portion sliding against each other.

9. The fuel pump according to claim 1, wherein the cylinder has two or more transversal through-holes each formed as a fuel path through a side portion thereof.

10. The fuel pump according to claim 1, wherein the plunger includes a large-diameter portion which slides in the cylinder and a small-diameter portion which has a first diameter smaller than a second diameter of the large-diameter portion, and a fuel passage is formed in the pump housing, the fuel passage connects between a low pressure fuel chamber side and the small-diameter portion side of the plunger.

11. The fuel pump according to claim 10, wherein a fuel contacting with the plunger flows into the low pressure fuel chamber side via the fuel passage with sliding movement of the plunger.

12. The fuel pump according to claim 1, wherein the press-fitting portion is a first press-fitting portion, and the outer peripheral surface portion of the cylinder further includes a second press-fitting portion.

13. The fuel pump according to claim 12, wherein the first press-fitting portion and the second press-fitting portion are positioned away from where the cylinder and the plunger slide against each other.

14. The fuel pump according to claim 12, wherein a sliding portion on which the plunger slides is formed on a part of an inner peripheral surface of the cylinder, and the sliding portion is positioned closer to an open end side of the concave portion than the second press-fitting portion.

* * * * *